United States Patent [19]

Capannoli

[11] Patent Number: 4,472,272

[45] Date of Patent: Sep. 18, 1984

[54] APPARATUS FOR WASHING INERT MATERIAL

[76] Inventor: Palmiero Capannoli, Monteriggioni, Siena, Italy

[21] Appl. No.: 441,147

[22] Filed: Nov. 12, 1982

[30] Foreign Application Priority Data

Nov. 12, 1981 [IT] Italy ..... 25030 A/81

[51] Int. Cl.[3] ..... B08B 3/04; B07B 1/00

[52] U.S. Cl. ..... 209/268; 209/261; 209/252; 209/292; 209/294; 134/60; 134/132

[58] Field of Search ..... 209/240, 241, 242, 268, 209/269, 270, 284, 288, 289, 155, 450, 451, 452, 449, 292, 261, 252, 299, 298, 294; 134/60, 65, 132–134, 112

[56] References Cited

U.S. PATENT DOCUMENTS

| | | | |
|---|---|---|---|
| 1,422,309 | 7/1922 | Schweinsberg et al. | 134/65 |
| 2,074,788 | 3/1937 | Holloman et al. | 134/60 |
| 2,375,499 | 5/1945 | Shigley | 209/452 |
| 4,399,828 | 8/1983 | Kontos | 134/65 |

*Primary Examiner*—Tim R. Miles

*Assistant Examiner*—Wm. Bond

*Attorney, Agent, or Firm*—McAulay, Fields, Fisher, Goldstein & Nissen

[57] ABSTRACT

In order to wash inert materials, even of a large size, with a limited amount of washing liquid and with a lesser consumption of energy and without moving metal parts, apparatus having a plurality of tubular rotors (1) which are in side-by-side relation but spaced a distance from each other and are rigidly locked with a common shaft (13) which is horizontal or at an angle with respect to the horizontal, in which each rotor (1) has a plurality of transverse annular baffle plates (2) adapted to delimit corresponding annular channels (3) and having in each channel (3) a plurality of peripheral boxes (15). As the rotors (1) revolve, the washing liquid overflows to the outside over the lower baffle plate (2) of each rotor (1) and the material being washed, which is introduced through the mouth of the rotor (1) located at one end of the apparatus, advances against the current through all the rotors (1) until it is discharged from the mouth of the rotor (1) located at the other end.

18 Claims, 4 Drawing Figures

APPARATUS FOR WASHING INERT MATERIAL

FIELD OF THE INVENTION

The present invention relates to an apparatus for washing inert materials such as sand, gravel and similar materials.

As is well known inert materials must be washed before undergoing washing use especially as to construction materials, in order to eliminate therefore mud, slime, dust, and organic matter.

For this purpose, there exist apparatus of the screw-feeder type consisting essentially of a slightly inclined oblong tube, inside which rotates an Archimedes screw. The material to be washed is fed at the lower end of the tub, while the washing liquid, generally water, is poured in at the upper end. As the washing liquid is fed continuously, it overflows the lower rim, carrying along the impurities contained in the inert material. The latter, in turn, is transported by the screw feeder towards the upper end, from which it is discharged.

This type of screw feeders has the disadvantage that the inert material is inadequately washed, especially if it is very dirty, since it is subjected to only one washing cycle. Besides, the operational cost of this type of machine is very high. Large amounts of washing liquid, particularly water, are indeed necessary, and this is a drawback in view of the ever-diminishing supply of water. Furthermore, the high friction calls for greater power to drive the rotating screw feeder, and there is a pronounced wear of the screw's edges, hence the need for frequent replacement of the wornout mechanical parts. Another serious limitation of this prior art machine is the impossibility of washing inert material consisting of particles larger than 5–8 mm.

Types of bucket machines are likewise known which consist of a semicylindrical tube filled with inert material and washing liquid, in which the buckets, radially fastened to a central shaft, dip, mix and raise the material, filtering the washing liquid through suitable holes made in the buckets, and discharging the washed inert material into adjacent compartments.

In this type of machines as well the resulting friction is a great disadvantage as is the great amount of power needed for the operation, since the wet sand becomes very compact. In addition, the washing operation turns out to be very inadequate in this case also, especially in the case of very dirty material. Moreover, only small amounts of washed inert material are produced each time. Consequently, the known bucket machine has low efficiency. Finally, also in this case it is not possible to wash inert material of sizes larger than 5–8 mm, as sometimes required.

OBJECTS AND SUMMARY OF THE INVENTION

The object of the invention is to provide an apparatus for washing inert materials such as sand, gravel, and the like which eliminate or greatly reduce these drawbacks.

This object has been achieved, in apparatus according to the invention, by mounting a plurality of tubular rotors in side-by-side arrangement but spaced at a distance from one another and rigidly locked with a common inclined or horizontal shaft, each rotor having annular baffle plates in order to delimit annular channels and having in each channel a plurality of peripheral boxes with perforated bottoms, further having a riser wall which is inclined in relation to the shaft so that, as the rotors revolve, the washing liquid entering each rotor overflows to the outside over the lower baffle plate of each rotor, and the material to be washed, fed at the mouth of the rotor located at one end of the apparatus, advances againt the liquid flow, passing through all the rotors until it is discharged through the mouth of the rotor located at the other end of the apparatus.

The advantages of this invention essentially consist in that it is possible to wash inert materials of any size even when they are dirty, that the consumption of washing liquid and motive power is much less than for machines of known construction, also with respect to the quantity of clean inert materials, that the equipment will have a long service life and require a minimum of maintenance.

BRIEF DESCRIPTION OF THE DRAWING

The invention will now be described in greater detail hereinbelow with the aid of the accompanying drawing in which only one embodiment of the invention is shown and wherein.

DISCLOSURE OF THE PREFERRED EMBODIMENTS

Figure 1:
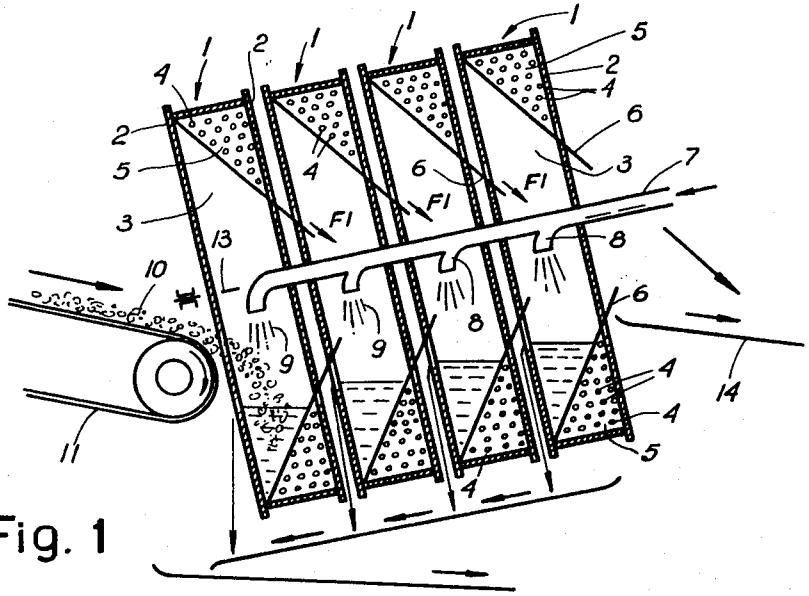
FIG. 1 is a longitudinal section of a first embodiment of the apparatus embodying the invention.

Now, referring to FIG. 1 of the accompanying drawings, the apparatus of this invention essentially comprises:

a plurality of tubular rotors (1) in side-by-side arrangement, but spaced at a distance from one another, and rigidly keyed on a common shaft (13) which is horizontal or, preferably, slightly inclined with respect to the horizontal; each rotor has two transverse annular baffle plates (2) delimiting an annular channel (3). A plurality of boxes (15) (FIG. 3) are mounted within each annular channel (3), each consisting of a triangular bottom (5) with holes (4) and a continuous riser wall (6) curved at an angle in relation to the bottom (5) and either protruding or not protruding from said annular channel. Said wall (6) is inclined with respect to the shaft (13) of the rotors (1) and extends along said shaft, preferably in such manner that the free end is inside the the annular channel (3) of the upper adjacent rotor (1), while the wall (6) of the rotor (1) located at the upper end of the apparatus protrudes outwardly so that the collecting and conveying means (14) can receive the washed inert material at the end of the washing cycle. From the construction viewpoint, each riser wall (6) may not be protruding from the associated annular channel as long as its inclination with respect to the shaft (13) is such as to make the inert material flow into the next annular channel (3) or outside the equipment, if the rotor (1) is the last one.

Figure 3:
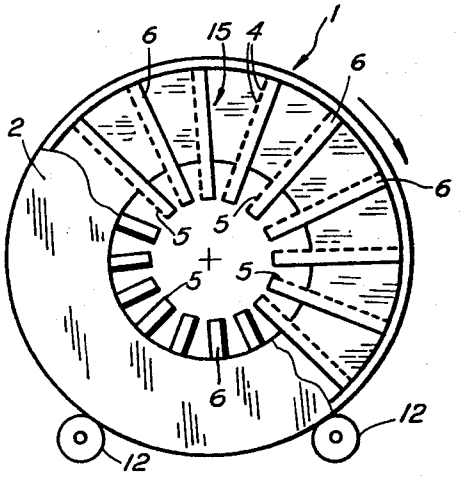
FIG. 3 is a front view of the discharge side for the inert material, after washing and, partially in section, of the apparatus shown in FIGS. 1 and 2.

As shown in FIG. 3, a plurality of rollers (12) are provided in order to support the rotors (1) and keep them rotating.

A pipe (7) to feed the washing liquid extends into the rotors, preferably in an axial direction, and has a plurality of openings (8), from which exits the washing liquid (9). In the embodiment shown in FIG. 1, each rotor (1) has an opening (8).

As shown in FIG. 1, means for feeding the dirty inert material (10) are mounted at the lower end of the apparatus and consist of a conveyor belt, a hopper, or the like.

Figure 2:
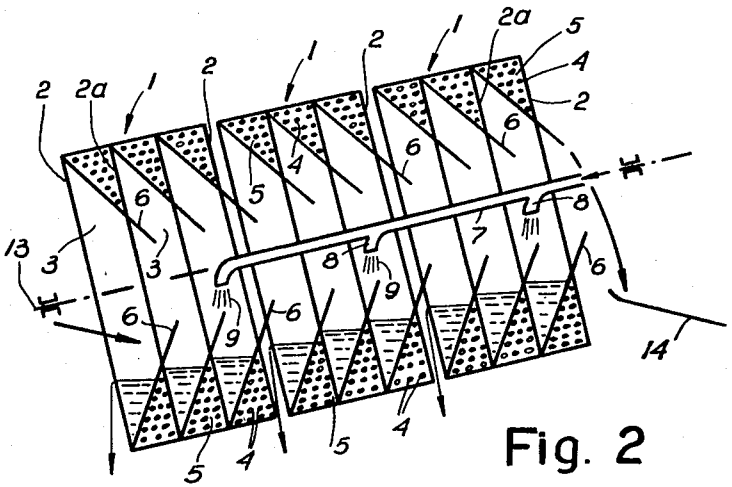
FIG. 2 is a longitudinal section of a second embodiment.

Referring to FIG. 2 of the accompanying drawings, each rotor (1) has a plurality of intermediate annular baffle plates **(2*a*) which delimit a plurality of annular channels (3). Further, the pipe (7), which feeds the washing liquid, has a discharge opening serving only the single upper annular channel (3) of each rotor, while the channels (3)** of each rotor located below the first are filled with the overflow water from the corresponding upper annular channel.

Figure 4:
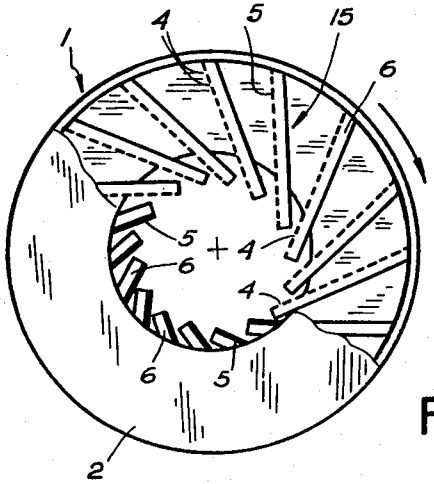
FIG. 4 shows a variant of FIG. 3.

FIGS. 3 and 4 of the accompanying drawings illustrate the arrangement of the boxes (15) according to two possible orientations, respectively, radial and at an angle with respect to the radius of the rotor (1). In each case, as the rotor (1) rotates, the washed inert material is discharged into the adjacent upper annular channel (3).

The apparatus operates as follows: The inert material to be washed is fed into the lower annular channel (3) at the lower end of the apparatus, while the feed pipe (7) supplies the washing liquid which fills the lower part of each channel (3) as far as the rim of the lower baffle plate (2), from which it overflows outwardly to the lower adjacent channel (3). The washing water or liquid, fed continuously in small quantities through the pipe (7), after overflowing into the permitted channels (3), is discharged underneath, carrying off the impurities which have been removed from the inert material. As a result of the revolutions of the rotors (1), the material being washed is raised by the boxes (15), letting the washing liquid drip through the holes (4) and, after a certain amount of lifting, due to the inclination of the walls (6), the inert material is discharged (in the direction indicated by the arrow F1 in FIG. 1) into the adjacent upper channel (3), because this wall protrudes beyond the baffle plate (2) of the corresponding channel (3). Thus, the inert material, after being discharged from the conveyor belt (11) and washed in the first adjacent channel (3) goes to the second adjacent channel (3), and so forth and so on, from channel (3) to channel (3) until it reaches the last channel, from which it is discharged into a chute (14) and thus removed.

I claim:

1. An apparatus for washing inert materials, comprising a feed pipe for washing liquid, means for conveying said inert materials, means for collecting and conveying the washed inert materials near said feed pipe, a plurality of tubular rotors in side-by-side relation but spaced at a distance from one another and fixed on a common shaft, each rotor having a plurality of transverse, annular baffle plates adapted to delimit with the sidewall of the rotor corresponding annular channels and having in each channel a plurality of riser walls forming peripheral boxes so that, as the rotors revolve, the washing liquid entering each rotor overflows to the outside over the lower baffle plates of each rotor and the material to be washed, fed at the mouth of a rotor located at one end of the apparatus, advances against the flow of said liquid, passing through all the rotors until it is discharged through the mouth of the rotor located at the other end of the apparatus.

2. The apparatus for washing inert materials according to claim 1, wherein a bottom of said boxes has holes and its riser wall is inclined to the same extent and in the same direction with respect to said shaft of the rotor.

3. The apparatus for washing inert materials according to claim 2, wherein said bottom of said boxes is secured in a radial direction to the wall of the corresponding rotor.

4. The apparatus for washing inert materials according to claim 2, wherein said bottom of said boxes is secured to the sidewall of the corresponding rotor in an inclined position with respect to the rotor radius.

5. The apparatus for washing inert materials according to claim 2, wherein said riser wall of said boxes extends in an axial direction with respect to the corresponding rotor so as to enable the inert materials, as the rotor revolves, to go to the adjacent annular channel.

6. The apparatus for washing inert materials according to claim 1, wherein said feed pipe for the washing liquid extends into the interior of all the rotors and has a plurality of discharge openings with at least one opening for each rotor.

7. The apparatus for washing inert materials according to claim 1, wherein said means for feeding the inert material to be washed extend into the interior of at least one of the annular channels of said rotor located at the corresponding end of the apparatus.

8. The apparatus of claim 1, wherein said shaft is horizontal.

9. The apparatus of claim 1, wherein said shaft is inclined.

10. The apparatus for washing inert materials according to claim 1, wherein a bottom of said boxes is secured in a radial direction to the wall of the corresponding rotor.

11. The apparatus for washing inert materials according to claim 1, wherein a bottom of said boxes is secured to the sidewall of the corresponding rotor in an inclined position with respect to the rotor radius.

12. The apparatus for washing inert materials according to claim 1, wherein the riser wall of said boxes extends in an axial direction with respect to the corresponding rotor so as to enable the inert materials, as the rotor revolves, to go to the adjacent annular channel.

13. The apparatus for washing inert materials according to claim 12, wherein said feed pipe for the washing liquid extends into the interior of all the rotors and has a plurality of discharge openings with at least one opening for each rotor.

14. The apparatus for washing inert materials according to claim 13, wherein said means for feeding the inert material to be washed extend into the interior of at least one of the annular channels of said rotor located at the corresponding end of the apparatus.

15. The apparatus for washing inert materials according to claim 14, wherein said rotational shaft of the rotors is inclined with respect to the horizontal.

16. The apparatus for washing inert materials according to claim 14, wherein said rotational shaft of said rotors is horizontal.

17. The apparatus for washing inert materials according to claim 15, wherein said bottom of said boxes is secured to the sidewall of the corresponding rotor in an inclined position with respect to the rotor radius.

18. The apparatus for washing inert materials according to claim 16, wherein said bottom of said boxes is secured to the sidewall of the corresponding rotor in an inclined position with respect to the rotor radius.

* * * * *